US008789221B2

(12) United States Patent
Polevoy et al.

(10) Patent No.: US 8,789,221 B2
(45) Date of Patent: Jul. 29, 2014

(54) UNITARY T-SHAPED BED FRAME MEMBER

(75) Inventors: Richard S. Polevoy, Teaneck, NJ (US); Paul Eric Carlson, Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 301 days.

(21) Appl. No.: 13/436,515

(22) Filed: Mar. 30, 2012

(65) Prior Publication Data

US 2012/0246825 A1 Oct. 4, 2012

Related U.S. Application Data

(60) Provisional application No. 61/469,876, filed on Mar. 31, 2011.

(51) Int. Cl.
*A47C 19/02* (2006.01)

(52) U.S. Cl.
USPC ..... 5/200.1; 5/131

(58) Field of Classification Search
USPC ..... 5/200.1, 132, 135, 201, 203, 206
See application file for complete search history.

(56) References Cited

U.S. PATENT DOCUMENTS

| | | | | |
|---|---|---|---|---|
| 1,108,515 A * | 8/1914 | Laden | ..... | 5/238 |
| 4,536,904 A * | 8/1985 | Whitehead | ..... | 5/201 |
| 8,006,328 B2 * | 8/2011 | Polevoy et al. | ..... | 5/200.1 |

* cited by examiner

*Primary Examiner* — Fredrick Conley
(74) *Attorney, Agent, or Firm* — Klauber & Jackson LLC

(57) ABSTRACT

A unitary, one piece, T-shaped bed frame structural member. The member is usable as a side rail, a cross member or any other structural member of a bed frame. The T-shape includes a wide flange forming the large member of the T-shape with a short flange extending outwardly from the wide flange at about the center thereof. At the intersection of the wide and short flanges, two fillets are formed therebetween that are similar in shape and have a series of circular arcs having predetermined radii and the circular arcs meet together forming a straight line along the longitudinal length of the structural member. The presence and shape of the fillets improves the strength and manufacturability of the T-shaped bed frame structural member or members.

15 Claims, 2 Drawing Sheets

UNITARY T-SHAPED BED FRAME MEMBER

REFERENCE TO RELATED APPLICATIONS

This patent application is based upon and hereby claims priority to U.S. Provisional Application Ser. No. 61/469,876 filed Mar. 31, 2011 and entitled "UNITARY T-SHAPED BED FRAME MEMBER" and the disclosure of that provisional application is hereby incorporated herein in its entirety by reference.

FIELD OF THE INVENTION

The present invention relates to a bed frame for supporting a mattress or mattress set and, more particularly, to a bed frame that has a unitary, one-piece supporting member having a T-shaped configuration.

BACKGROUND OF THE INVENTION

The present invention relates to bed frames, and, more particularly, to a bed frame made up of one or more T-shaped structural bed frame members. The use of a unitary or one piece bed frame member has been disclosed in U.S. Pat. No. 7,363,664, issued Apr. 29, 2008 to Polevoy et al. In that patent, there is described the advantages of utilizing a T-shaped member for a bed frame and, more particular, to the use of a unitary, one piece T-shaped bed frame member as a side rail or as a cross member.

The T-shaped member of the '664 patent disclosed therein, however, can be improved with respect to its ability to be manufactured and to an increase in strength by utilizing a particular design of the intersection of the flanges of a T-shaped bed frame member.

It would thus be advantageous to have a unitary, one piece, T-shaped, bed frame member that can be used as a side rail, cross member or other structural bed frame member that has improved manufacturing capability as well as enhanced strength.

SUMMARY OF THE INVENTION

Now, in accordance with the present invention, there is provided a specially configured T-shaped bed frame member with improved manufacturability and strength.

With the present invention, a unitary, one piece T-shaped bed frame member is provided that is suitable for a side rail, a cross member or any other structural member of a bed frame. The T-shape includes a wide flange forming the large member of the T-shape with a short flange extending outwardly from the wide flange at about the center thereof.

As such, there is an intersection between the short flange and the wide flange and two fillets are formed between the mating surfaces at that intersection. The fillets are similar and both have a series of circular arcs having predetermined radii and the circular arcs meet together forming a straight line.

Other features of the present T-shaped bed frame member will become more apparent in light of the following detailed description of a preferred embodiment thereof and as illustrated in the accompanying drawings.

DETAILED DESCRIPTION OF THE INVENTION

Figure 1:
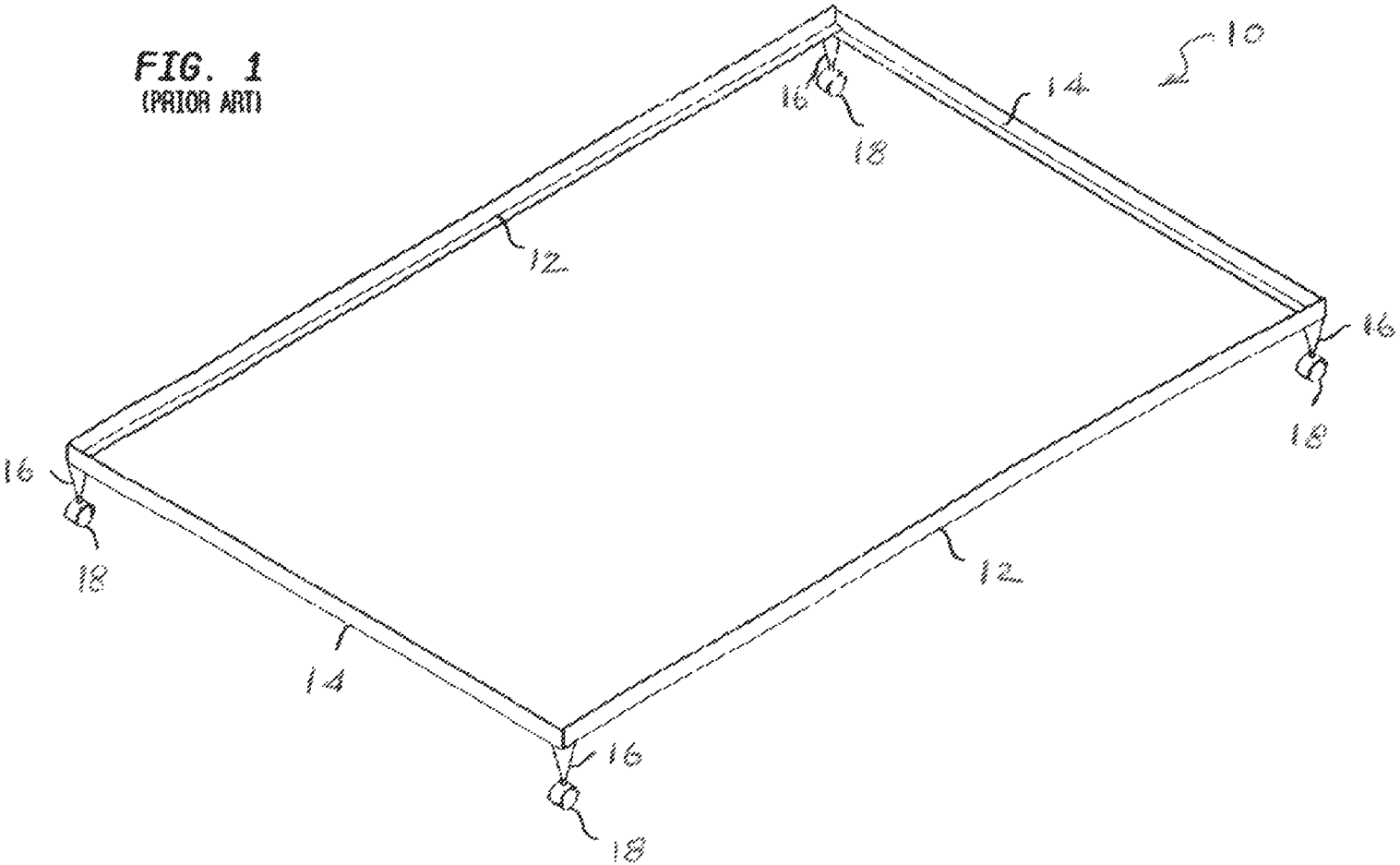
FIG. 1 (PRIOR ART)
FIG. 1 is a perspective view of a conventional bed frame construction.

Taking FIG. 1, there is shown a perspective view of a conventional bed frame 10. As can be seen, the bed frame 10 is comprised of a pair of side rails 12 and cross members 14. The number of cross members 14 may vary depending upon the particular bed, and its size, that is, there may be one or more intermediate cross members that provide additional support to the box spring and mattress when assembled. As shown, there are legs 16 that are normally located on the cross members 14 or the side rails 12 depending on the particular construction of the bed frame 10 and, if any further cross members are used in the bed frame 10, there may also be one or more additional legs extending downward from those cross members. At the bottom of the legs 16, there are affixed thereto casters 18 that are in contact with the floor.

As can be seen in FIG. 1, the conventional construction of the side rails 12 and cross members 14 is an L-shaped angle iron, however in the aforesaid U.S. Pat. No. 7,363,664 there is disclosed the use of a T-shaped member that can be used as a structural member of a bed frame, that is, as either a cross member or a side rail. Conventionally, T-shaped members have been used for cross members in commercial bed frames, however the T-shape has, in those bed frames, been conventionally constructed by the joining together of two L-shaped angle irons.

Accordingly, in the '664 patent, there is shown the use of a unitary, one piece T-shaped structural bed frame member that can be used in a bed frame assembly.

Figure 2:
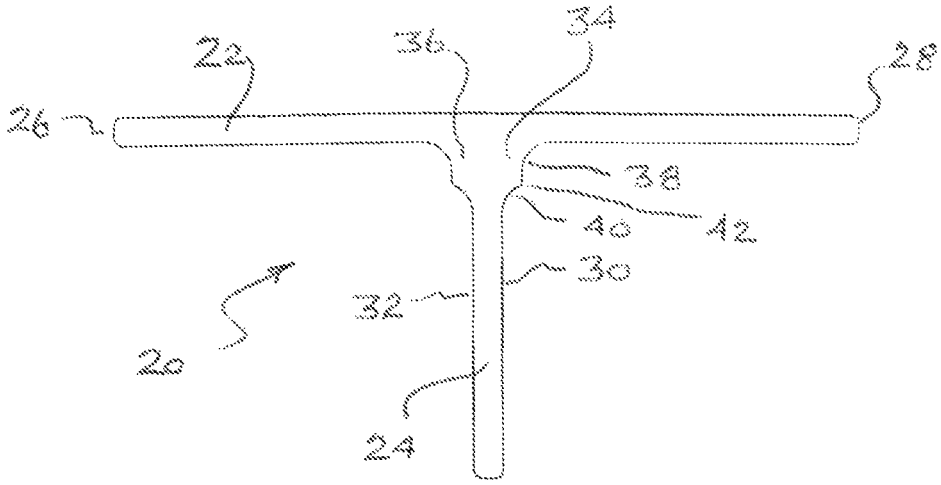
FIG. 2 is a cross sectional view of a unitary, T-shaped bed frame member constructed in accordance with the present invention.

Turning then to FIG. 2, taken along with FIG. 1, there is shown a cross sectional view of a unitary, T-shaped bed frame member 20 that can be used for either the side rails 12, cross members 14 or both. As used herein, the term "unitary" or "unitary, one-piece" means that the side rails or cross members are constructed of a single piece of material and not two components joined together, The preferred material used in the present invention is steel, however, other metals, such as aluminum may be applicable. In the manufacture of a unitary, one piece bed frame member, the T-shaped member can be rolled from a steel member with a series of rollers that define the ultimate shape of the member.

Thus, in FIG. 2, the T-shaped member 20 has a wide flange 22 and a short flange 24 such that the wide flange 22 is generally about twice the length of the short flange 24. The wide flange 22 has outer edges 26, 28 and the short flange 24 extends outwardly from the wide flange 22 at a location about mid way between those outer edges 26, 28 to form a normal T-shape.

The short flange 24 has oppositely disposed outer surfaces, that is, there is a first surface 30 and second surface 32. The first surface 30 and the second surface 32 intersect with the wide flange 22 such that a first fillet 34 and a second fillet 36 are formed, respectively, between those surfaces.

As used herein, a fillet is normally a rounded off area that is formed in the junction angle between two surfaces and, with a T-shaped junction, there are two such fillets. As shown, therefore, first and second fillets 34 and 36 are specially designed to facilitate the manufacture of the bed frame member 20 and to enhance the strength of the junction between the wide flange 22 and the short flange 24.

Accordingly, both fillets 34, 36 are similarly configured and, taking the fillet 34 as an example for explaining the invention, the fillet 34 is comprised of a pair of circular arcs 38, 40 meeting at a linear line 42 that extends along the longitudinal length of the T-shaped member 20. Each of the circular arcs 38, 40 is an arc of a circle having a predetermined radius and the radii of the circular arcs 38, 40 may, in one exemplary embodiment, have a larger radius for the circular arc 38 closer to the wide flange 22. Alternatively, the radii of the circular arcs 38, 40 may be equal.

As can be seen, the circular arc 38 is close to and merges into the wide flange 22 while the circular arc 40 is more remote from the wide flange 22 and merges into the short flange 24.

With the present invention, therefore, while the description of an exemplary embodiment illustrates the use of the unitary, one piece T-shaped member is with the use as a side rail or cross member, the present member may be used for any other structural member used in the construction of a bed frame.

While the present invention has been set forth in terms of a specific embodiment of embodiments, it will be understood that the present unitary T-shaped bed frame side rail or cross member herein disclosed may be modified or altered by those skilled in the art to other configurations. Accordingly, the invention is to be broadly construed and limited only by the scope and spirit of the claims appended hereto.

What is claimed is:

1. A bed frame assembly comprising:

a pair of spaced apart side rails and at least one cross member spanning between the side rails, at least one of the side rails or the cross member being of a unitary, one piece construction having a T-shaped cross section, the T-shaped cross section comprising a wide flange having outer edges and a single, solid short flange intersecting and extending outwardly from the wide flange intermediate the outer edges of the wide flange, the short flange having opposed first and second surfaces, the intersection of the short flange and the wide flange having first and second fillets intersecting, respectively, the first and second surfaces of the short flange with the wide flange, the cross section of the first and second fillets configured as two adjoining circular arcs meeting along a line that extends along the longitudinal length of the at least one of the side rail or the cross member.

2. The bed frame assembly as defined in claim 1 wherein the two adjoining circular arcs comprise a first circular arc close to and merging into the wide flange, the first circular arc having a predetermined radius and a second circular arc more remote from the wide flange and merging into the short flange, the second arc having a predetermined radius.

3. The bed frame assembly as defined in claim 2 wherein the predetermined radius of the first circular arc is about equal to the predetermined radius of the second circular arc.

4. The bed frame assembly as defined in claim 2 wherein the predetermined radius of the first circular arc is larger than the predetermined radius of the second circular arc.

5. The bed frame assembly as defined in claim 1 wherein both of the spaced apart side rails are of a one piece construction having a T-shaped cross section.

6. The bed frame assembly as defined in claim 1 wherein the at least one cross member is of a one piece construction having a T-shaped cross section.

7. The bed frame assembly as defined in claim 1 wherein the side rails are generally parallel and the at least one cross member is generally perpendicular to the side rails.

8. The bed frame assembly as defined in claim 1 wherein the short flange is located at about mid way between the outer edges of the wide flange.

9. A method of constructing a bed frame comprising the steps of:

providing at least one, unitary bed frame structural member having a T-shaped cross section, the T-shaped cross section comprising a wide flange having outer edges and a single, solid short flange intersecting and extending outwardly from the wide flange at about midway between the outer edges of the wide flange, the short flange having opposed first and second surfaces, the intersection of the short flange and the wide flange resulting in first and second fillets intersecting, respectively, the first and second surfaces of the short flange with the wide flange, the cross section of the first and second fillets configured as two adjoining circular arcs meeting along a line; and connecting the at least one, unitary bed frame structural member to at least one other unitary bed frame structural member to form a bed frame.

10. The method of claim 9 wherein the step or providing at least one, unitary bed frame structural member comprises providing two unitary bed frame structural members aligned parallel to each other and the step of connecting the at least one, unitary bed frame structural member comprises connecting a plurality of cross members between each of the two, unitary bed frame structural members to form a rectangular bed frame.

11. A structural member for a bed frame, the structural member comprising an elongated metal member of a unitary, one piece construction having a T-shaped cross section, the T-shaped cross section comprising a wide flange having outer edges and a single, solid short flange intersecting and extending outwardly from the wide flange intermediate the outer edges of the wide flange, the short flange having opposed first and second surfaces, the intersection of the short flange and the wide flange having first and second fillets intersecting, respectively, the first and second surfaces of the short flange with the wide flange, the cross section of the first and second fillets configured as two adjoining circular arcs meeting along a line that extends along the longitudinal length of the at least one of the side rail or the cross member.

12. The structural member as defined in claim 11 wherein the two adjoining circular arcs comprise a first circular arc close to and merging into the wide flange, the first circular arc having a predetermined radius and a second circular arc more remote from the wide flange and merging into the short flange, the second arc having a predetermined radius.

13. The structural member as defined in claim 12 wherein the predetermined radius of the first circular arc is about equal to the predetermined radius of the second circular arc.

14. The structural member as defined in claim 12 wherein the predetermined radius of the first circular arc is larger than the predetermined radius of the second circular arc.

15. The structural member as defined in claim 11 wherein the short flange is located at about mid way between the outer edges of the wide flange.

* * * * *